US006513731B2

(12) United States Patent
Griffin et al.

(10) Patent No.: US 6,513,731 B2
(45) Date of Patent: Feb. 4, 2003

(54) AERATOR WITH VARIABLE AIR INPUT

(75) Inventors: John A. Griffin, New Bern, NC (US); John C. Holzheimer, Burton, OH (US); Edward A. Nasser, New Bern, NC (US)

(73) Assignee: Moen Incorporated, North Olmsted, OH (US)

( * ) Notice: Subject to any disclaimer, the term of this patent is extended or adjusted under 35 U.S.C. 154(b) by 61 days.

(21) Appl. No.: 09/751,263

(22) Filed: Jan. 2, 2001

(65) Prior Publication Data

US 2002/0084353 A1 Jul. 4, 2002

(51) Int. Cl.[7] ..... A62C 31/02
(52) U.S. Cl. ..... 239/394; 239/407; 239/428.5
(58) Field of Search ..... 239/394, 428.5, 239/407, 416.5

(56) References Cited

U.S. PATENT DOCUMENTS

| | | | | |
|---|---|---|---|---|
| 2,962,225 | A | | 11/1960 | Aghnides |
| 2,998,931 | A | | 9/1961 | Aghnides |
| 2,998,933 | A | | 9/1961 | Aghnides |
| 3,270,964 | A | | 9/1966 | Aghnides |
| 3,363,841 | A | | 1/1968 | Aghnides |
| 3,417,924 | A | | 12/1968 | Aghnides |
| 3,554,451 | A | | 1/1971 | Aghnides |
| 3,633,824 | A | | 1/1972 | Aghnides |
| 3,635,405 | A | | 1/1972 | Shames et al. |
| 3,684,191 | A | | 8/1972 | Shames et al. |
| 3,712,548 | A | | 1/1973 | Aghnides |
| 3,811,619 | A | | 5/1974 | Aghnides |
| 3,827,636 | A | | 8/1974 | Parkinson et al. |
| 4,153,204 | A | | 5/1979 | Aghnides |
| 4,221,337 | A | | 9/1980 | Shames et al. |
| 4,221,338 | A | | 9/1980 | Shames et al. |
| 4,345,719 | A | | 8/1982 | Bock |
| 4,365,755 | A | | 12/1982 | Aghnides |
| 4,470,546 | A | | 9/1984 | Wildfang |
| 4,530,467 | A | | 7/1985 | Bueno |
| 4,534,513 | A | | 8/1985 | Aghnides |
| 4,534,514 | A | | 8/1985 | Aghnides |
| 4,562,960 | A | | 1/1986 | Marty et al. |
| 4,637,552 | A | | 1/1987 | Finkbeiner et al. |
| 4,928,885 | A | * | 5/1990 | Nakao ..... 239/417 |

(List continued on next page.)

*Primary Examiner*—Christopher Kim
(74) *Attorney, Agent, or Firm*—Cook, Alex, McFarron, Manzo, Cummings & Mehler, Ltd.

(57) ABSTRACT

An aerator includes a housing, a throttle assembly, a mixing chamber, a screen and an elastometric ring. The throttle assembly includes a first or upper throttle member and a second or lower throttle member, each of the upper and lower throttle members defining a portion of a snap element. The snap element allows for retention and relative rotation of one of the first and second throttle members in order to change the air content of the water stream from a closed aerator position which provides a substantially non-aerated water stream to an opened aerator position which provides a combined water and air stream. One embodiment of a snap element being defined by upper throttle projections and a lower throttle flange whereby the lower throttle flange is urged upstream of the upper throttle projections. The lower throttle member is retained by the upper throttle member for selective rotation by the user. The lower throttle upstream projections and beveled edges facilitate the insertion of the lower throttle member into the upper throttle member for a snap engagement therewith. Selective rotation of the lower throttle member by the user varies the air volume in the water stream. During rotation the lower throttle projections change the size of the air passageways defined by an upper throttle opening to allow more or less air through the passageways. Serrated edges on the upper and lower throttle members prevent rotation of the aerator unless manual force is applied. A slot located on a downstream end of the lower throttle member allows the user to rotate the lower throttle member.

16 Claims, 3 Drawing Sheets

U.S. PATENT DOCUMENTS

| | | | |
|---|---|---|---|
| 5,071,071 | A | 12/1991 | Chao |
| 5,114,072 | A | 5/1992 | Barhydt, Sr. |
| 5,348,231 | A | 9/1994 | Arnold et al. |
| 5,467,929 | A | 11/1995 | Bosio |
| 5,495,985 | A | 3/1996 | Nehm et al. |
| 5,769,326 | A | 6/1998 | Muchenberger et al. |
| 5,803,368 | A | 9/1998 | Shekalim |
| 6,029,912 | A | 2/2000 | Woolley |

* cited by examiner

Fig.12.
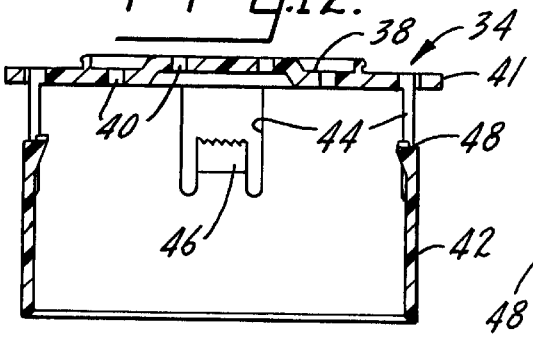
Fig.13.
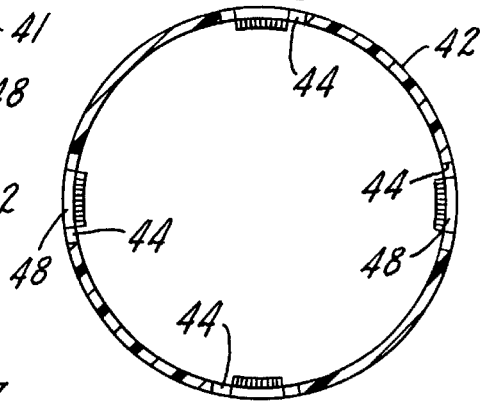
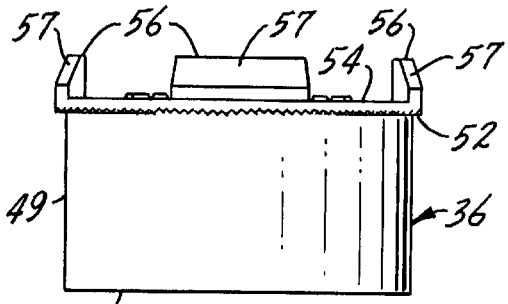
Fig.14.
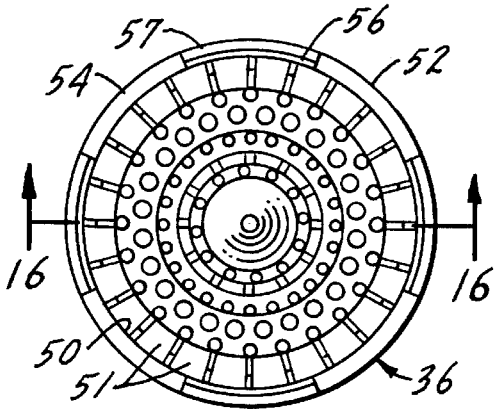
Fig.15.
Fig.17.
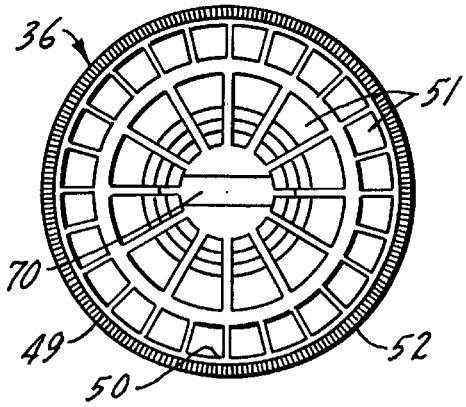
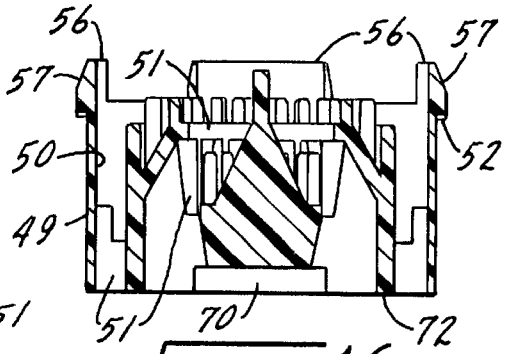
Fig.16.
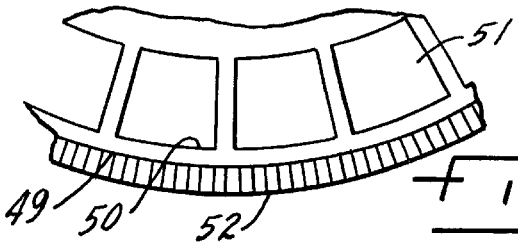
Fig.18.

AERATOR WITH VARIABLE AIR INPUT

FIELD OF THE INVENTION

The present invention relates to an aerator for attachment to a faucet in order to produce an aerated water stream. An aerated water stream is a desired feature because it produces a water stream with a softer feel. It also provides a water stream which is more aesthetically pleasing to the user than a non-aerated stream.

The present invention provides an aerator which allows for selectively choosing the amount of air within the water stream. It also provides an aerator with a limited number of parts which are fitted together in a snap engagement. The snap engagement allows retention and rotation of a portion of the aerator.

SUMMARY OF THE INVENTION

The present invention provides an aerator with variable air input through the use of a throttle assembly which has an upper throttle member and a lower throttle member. The lower throttle member is rotatable when the user desires a change in the air content and appearance of the water stream.

A primary purpose of the invention is to provide an aerator with first and second throttle members which snap together, one of the first and second throttle members being rotable relative to the other to allow the user to change the air content and appearance of the water stream.

Another purpose of the invention is to provide an aerator with a snap construction which simplifies aerator construction and cleaning thereof.

Another purpose of the invention is to provide an aerator with a limited number of parts for ease of construction.

Another purpose of the invention is to provide an aerator for a faucet which allows for manual rotation of a downstream end of the aerator by the user.

Another purpose of the invention is to provide an aerator which allows for a selective adjustment of the amount of air within the water stream by the user while the faucet is in use so that the user can adjust the feel of the water stream to a desired softness without having to turn off the faucet.

Other purposes will appear in the following specification, drawings and claims.

BRIEF DESCRIPTION OF THE DRAWINGS

The invention is illustrated diagrammatically in the following drawings wherein:

FIG. 12 is a section along plane 12—12 of FIG. 11;

FIG. 13 is a section along plane 13—13 of FIG. 10;

FIG. 14 is a side view of the lower throttle member;

FIG. 15 is a top view of the lower throttle member shown in FIG. 14.

FIG. 16 is a section along plane 16—16 of FIG. 15;

FIG. 17 is a bottom view of the lower throttle member; and

FIG. 18 is an enlarged partial bottom view of the lower throttle member.

DESCRIPTION OF THE PREFERRED EMBODIMENT

Figure 1:
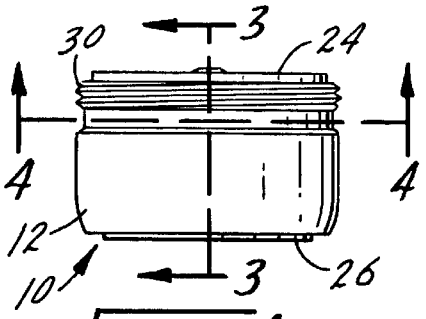
FIG. 1 is a side view of the aerator of the present invention.
Figure 2:
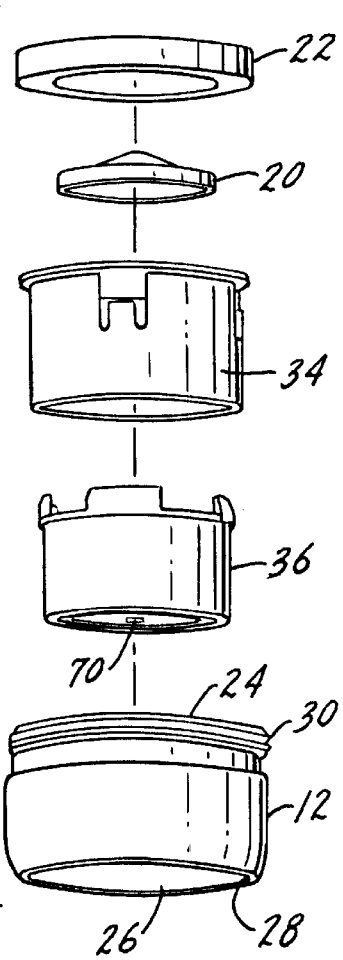
FIG. 2 is an exploded perspective view of the invention shown in FIG. 1.
Figure 3:
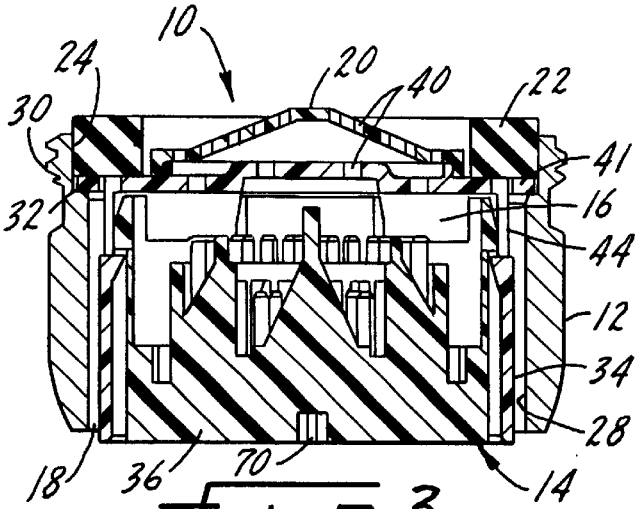
FIG. 3 is a section along plane 3—3 of FIG. 1.

FIGS. 1 through 3 show the rotatable aerator 10 of the present invention. The aerator 10 includes an outer housing 12, a throttle assembly 14, a mixing chamber 16, air passageways 18, a screen 20, and an elastomeric ring 22. The housing 12 includes a water inlet 24, a combined water and air outlet 26 and a generally cylindrical internal surface 28. Threads 30 adjacent the inlet 24 allow for the aerator to be threadably attached to a faucet spout. The internal surface 28 defines an upwardly facing opening therein and has an annular seat 32 adjacent the inlet 24 for mounting the throttle assembly 14. The throttle assembly 14 includes a first or upper generally cylindrical throttle member 34 and a second or lower generally cylindrical throttle member 36. Although the upper throttle member 34 is shown positioned upstream of the lower throttle member 36, other positions are also possible. Similarly, although the lower throttle member is shown as being insertable into the upper throttle member, other orientations are possible.

Figure 6:
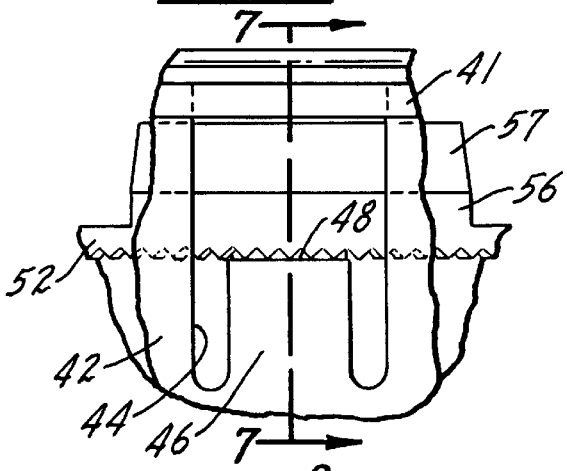
FIG. 6 is an enlarged partial side view of a snap element.

In FIGS. 10 through 13 the upper throttle member 34 is shown generally to include an upstream end 38 and a sleeve 42. The upstream end 38, which faces the housing inlet 24, has a plurality of circumferentially disposed water inlet ports 40 and an annular flange 41 which is positioned on the housing annular seat 32. The sleeve 42 extends downwardly from the upstream end 38 and includes a plurality of circumferentially spaced openings 44. The openings 44 each have upwardly facing projections 46 which extend upwards to an inwardly extending edge 48. All or a portion of the edge 48 has a serrated surface which is shown in FIG. 6.

FIGS. 14 through 18 illustrate the lower throttle member 36 which includes an external cylindrical surface 49 and an internal cylindrical surface 50 which defines a plurality of fluid passageways 51. An outwardly-extending flange 52 is located on an upstream end 54 of the external surface 49 and has a downwardly facing serrated edge. The flange 52 may also include a plurality of upstream directed projections 56. The projections 56 or a portion thereof may have beveled edges 57 which extend inwards of the housing and face the upper throttle member 34 when the upper and lower throttle members are joined together.

FIG. 3 shows the mixing chamber 16 which is located internally of the throttle assembly between the upper throttle member 34 and lower throttle member 36. Air passageways 18 allow the movement of air from the housing outlet 26 to the mixing chamber 16 for mixing with the water. The passageways 18 are defined by the area between the housing internal surface 28 and the upper throttle sleeve 42 and terminate at the upper throttle circumferentially spaced openings 44. Although the air passageways are shown as terminating at openings adjacent the upper throttle upwardly facing projections 46, other placement and orientation of openings are possible including that the openings be located on another portion of the throttle assembly if other snap engagements are used.

Figure 8:
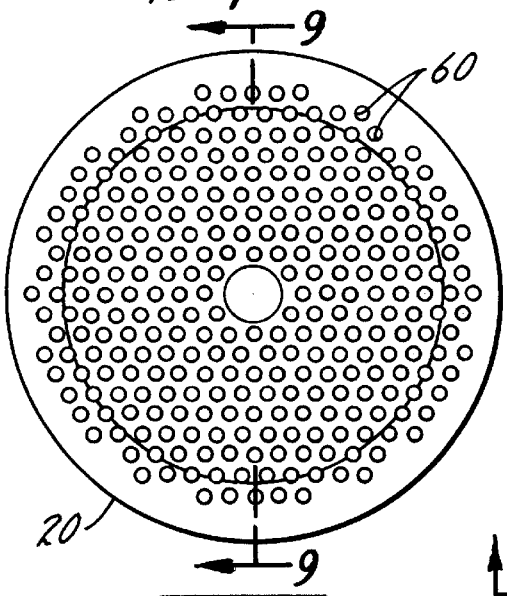
FIG. 8 is a top view of the screen.
Figure 9:
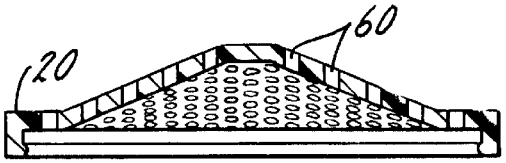
FIG. 9 is a section along plane 9—9 of FIG. 8.
Figure 11:
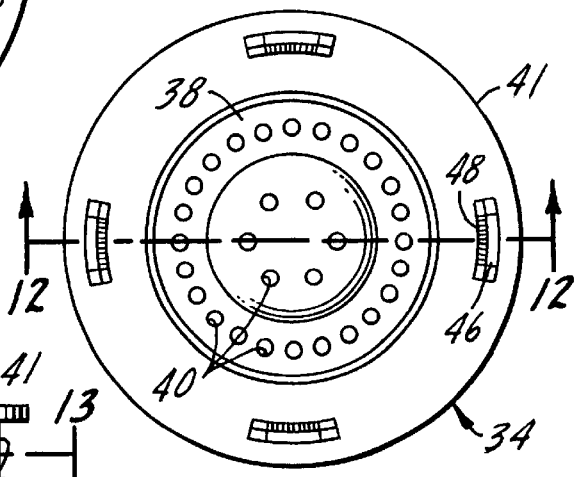
FIG. 11 is a top view of the upper throttle member.
Figure 10:
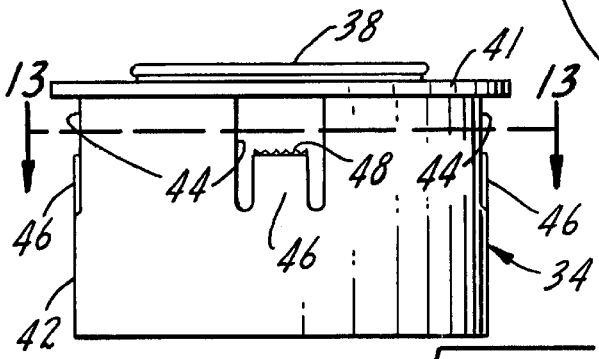
FIG. 10 is a side view of the upper throttle member.

In FIGS. 8 and 9 the screen 20 is shown having a frusto-conical shape and a plurality of water inlet holes 60. In FIGS. 2 and 3 the screen is positioned upstream of the throttle assembly 14 and covers the inlet ports 40 of the upper throttle member 34. Thus, when the aerator is fully assembled, the screen 20 will prevent particles from clogging the upper throttle inlet ports 40.

The elastomeric ring 22 is positioned upstream of the throttle assembly adjacent and surrounding the screen 20 and prevents water from leaking around the outside of the housing 12.

Figure 7:
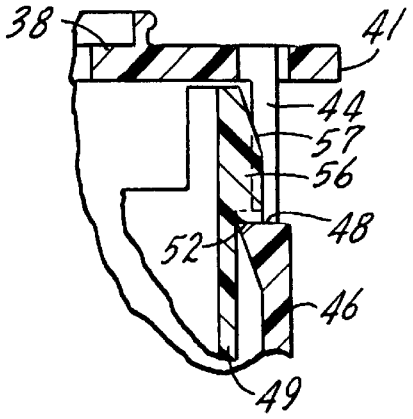
FIG. 7 is a partial section along plane 7—7 of FIG. 6.

To assemble the throttle assembly, the lower throttle member 36 is inserted into the upper throttle member 34. A snap engagement is formed, as shown in FIGS. 6 and 7, when the lower throttle flange 52 is urged upstream of the upper throttle projections 46 and inwardly extending edges 48 such that the lower throttle flange snaps over the upper throttle projections. The upstream projections 56 and beveled edges 57 of the lower throttle member 36 facilitate the insertion of the lower throttle member into the upper throttle member. Within the snap engagement, the serrated surfaces of the upper and lower throttle members are positioned adjacent each other and prevent rotation of the aerator unless desired by the user. Once the upper and lower throttle members are joined together, there is sufficient vertical clearance between the upper throttle upstream end 38 and the lower throttle upstream projections 56 to allow rotation of the lower throttle member. Such vertical clearance should be greater than the height of the individualized serrations located on the serrated edges if rotation is to occur during normal operation of the faucet. If however there is not enough vertical clearance for the user to perform rotation during faucet operation then it would be possible to rotate the aerator by disassembling the aerator and recombining the throttles in a rotated position.

Figure 4:
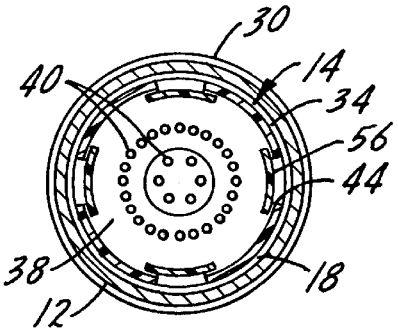
FIG. 4 is a section along plane 4—4 of FIG. 1.
Figure 5:
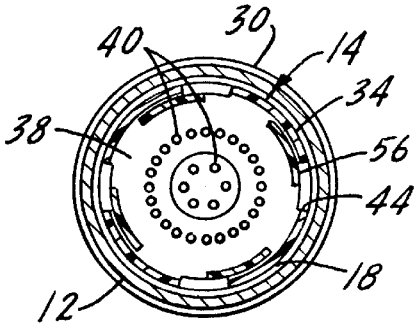
FIG. 5 is a view of FIG. 4 after rotation of the lower throttle member.

FIGS. 4 and 5 illustrate rotation of the throttle assembly which occurs when the user turns the lower throttle member 36 as it extends below the housing outlet 26. FIG. 4 shows the closed aerator position which is formed when the lower throttle projections 56 are positioned adjacent the upper throttle openings 44 to block the air passageways 18. The lower throttle projections 56 prevents all or substantially all air from entering the mixing chamber 16 to provide a non-aerated water stream. As shown in FIG. 4 the projection 56 is preferably greater in arcuate length than the upper throttle opening 44 in order to prevent air seepage from occurring around the lower throttle projection.

FIG. 5 shows a partially open throttle assembly after the lower throttle projections 56 have been rotated counterclockwise to a mid-range position. Rotation of the assembly does not occur unless desired by the user due to the engagement between the serrated edges of the upper and lower throttle members. Thus, the lower throttle member is prevented from rotating by itself during normal operation of the aerator and does not rotate unless desired by the user.

As the aerator 10 is rotated from the position shown in FIG. 4 to that shown in FIG. 5, air begins to flow into the throttle assembly through the portion of the upper throttle opening 44 which is unobstructed by the lower throttle projections 56. As the aerator is rotated from the closed position to a fully opened position, the size of the unobstructed portion increases and allows more air to enter the throttle assembly to provide an increasingly aerated stream. In a fully opened position the upper throttle opening 44 is completely unobstructed by the lower throttle projections 56 to allow for the maximum amount of air to mix with the water stream. Thus, rotation of the lower throttle projections 56 varies the size of the air passageways 18 defined at the upper throttle openings 44 to change the air volume within the water stream.

To facilitate the rotation of the lower throttle member by the user, a centrally disposed slot 70 is located on a downstream end 72 of the lower throttle member and the user may use an appropriately sized key such as a flat-headed screwdriver or other like object which inserts into the slot to assist rotation. Thus, the user can manually rotate the aerator at a downstream end of the lower throttle member to selectively change the amount of air drawn in and the appearance of the water stream.

Other methods may be employed to effectuate rotation of the lower throttle member by the user. For instance, a plurality of radial ribs may be located on the lower throttle member adjacent the housing outlet 26 and project downwards from the downstream end 72 in order to provide a frictional surface to assist in manual rotation of the lower throttle member by the user. It may also be possible for circumferentially disposed grooves to be located on the lower throttle member adjacent the housing to facilitate aerator rotation.

It is also possible for the upper and lower throttle members to fit together with an alternate snap engagement. Each of the upper and lower throttle members includes a portion of the snap element such as flanges, projections or the like. When the two throttle members are joined together, the snap element allows for retention and relative rotation of one of the upper and lower throttle members and the other of the throttle members remains substantially stationary in the housing.

Whereas the preferred form of the invention has been shown and described herein, it should be realized that there may be many modifications, substitutions and alterations thereto.

What is claimed is:

1. An aerator for a faucet comprising:

a housing having an inlet and an outlet and an internal cavity, a throttle assembly positioned within said housing and having first and second throttle members, each of said first and second throttle members defining a plurality of fluid passageways and having a portion of a snap element, said snap elements allowing for retention and relative rotation of said second throttle member in said throttle assembly, said first throttle member remaining substantially stationary in the housing, at least one air passageway in the housing for communication of ambient air to the throttle assembly, selective rotational movement of said second throttle member changing the size of the air passageway to vary the air volume in the water stream.

2. The aerator of claim 1 wherein the first throttle member is positioned upstream of the second throttle member.

3. The aerator of claim 1 wherein the second throttle member is insertable into the first throttle member.

4. The aerator of claim 1 wherein the first throttle member has a sleeve which extends downwardly from an upstream end and a plurality of circumferentially spaced openings disposed on the sleeve.

5. The aerator of claim 1 wherein said snap elements have a plurality of upwardly facing projections with inwardly extending edges located on the first throttle member and an outwardly extending flange on the second throttle member, said second throttle flange capable of being urged upstream of the first throttle projections to form a snap fit.

6. The aerator of claim 1 wherein at least one of said first and second throttle members has a plurality of upstream projections.

7. The aerator of claim 6 wherein said upstream projections are positioned on the second throttle member, selective rotation of the second throttle member providing for opening and closing of the aerator.

8. The aerator of claim 7 wherein a portion of said second throttle upstream projections are directed at an inward angle from the housing to guide the snap elements together.

9. The aerator of claim 1 wherein a downstream end of the throttle assembly has a slot disposed therein to allow for the insertion of a key to effectuate rotation during use of the faucet.

10. The aerator of claim 1 wherein each of said snap elements have a serrated edge which engage one another within the throttle assembly to prevent rotation of the aerator unless desired by the user.

11. The aerator of claim 4 wherein said at least one air passageway terminates at said circumferentially spaced openings disposed on the sleeve.

12. An aerator for a faucet comprising:

a housing having a water inlet, a water and air outlet and an internal surface defining an annular seat adjacent the inlet for mounting a throttle assembly within the housing;

the throttle assembly including an upper throttle member and a rotable lower throttle member, said upper throttle member having an upstream end which faces the housing inlet and defines a plurality of inlet ports, and a downwardly extending sleeve, said sleeve having a plurality of circumferentially spaced openings and a plurality of upwardly facing projections with an inwardly extending edge, said lower throttle member defining a plurality of fluid passageways and an outwardly extending flange located on an upstream end of the lower throttle member, said lower throttle member being insertable into the upper throttle sleeve in a snap engagement to allow for retention and relative rotation of the lower throttle member within in the upper throttle member, the snap engagement being formed when the lower throttle flange is urged upstream of the upper throttle projections such that the lower throttle flange snaps over the upper throttle projections;

a mixing chamber defined internally between the upper throttle member and lower throttle member;

a plurality of air passageways leading from an external opening in the housing outlet to the mixing chamber for drawing air into the mixing chamber for mixing with the water therein, said passageways providing communication with the throttle assembly when the user selectively rotates said one of the first and second throttles members from a closed aerator position to an opened aerator position;

a screen positioned upstream of the throttle assembly covering the upper throttle inlet ports for preventing particles from clogging the throttle assembly; and an elastomeric ring located adjacent the upstream end of the throttle assembly.

13. The aerator of claim 12 wherein said lower throttle flange includes a plurality of upstream projections to provide for opening and closing of the aerator and for guiding of the upper and lower throttles into the snap engagement.

14. The aerator of claim 13 wherein each of said lower throttle upstream projections have a beveled edge which faces the upper throttle projections to guide the lower throttle flange and the upper throttle projections into a snap engagement.

15. The aerator of claim 12 wherein a downstream end of the lower throttle member has a centrally disposed slot to allow for the insertion of a key to effectuate rotation during use of the faucet.

16. The aerator of claim 12 wherein the upper throttle projections and the lower throttle flange have serrated edges which engage one another during snap engagement to prevent rotation of the aerator during normal operation of the aerator.

* * * * *